US009587419B1

(12) United States Patent
Turner

(10) Patent No.: US 9,587,419 B1
(45) Date of Patent: Mar. 7, 2017

(54) DOOR SWING STOP

(71) Applicant: David Turner, Jefferson, GA (US)

(72) Inventor: David Turner, Jefferson, GA (US)

( * ) Notice: Subject to any disclaimer, the term of this patent is extended or adjusted under 35 U.S.C. 154(b) by 0 days.

(21) Appl. No.: 14/846,217

(22) Filed: Sep. 4, 2015

Related U.S. Application Data

(60) Provisional application No. 62/192,252, filed on Jul. 14, 2015.

(51) Int. Cl.

| | |
|---|---|
| ***E05C 17/02*** | (2006.01) |
| ***E05D 11/00*** | (2006.01) |
| ***E05D 5/12*** | (2006.01) |
| ***E05D 3/02*** | (2006.01) |

(52) U.S. Cl.
CPC ..... *E05D 11/00* (2013.01); *E05C 17/02* (2013.01); *E05D 3/02* (2013.01); *E05D 5/12* (2013.01); *E05D 5/121* (2013.01); *E05D 2005/122* (2013.01); *Y10T 16/61* (2015.01)

(58) Field of Classification Search
CPC ..... E05C 17/02; E05C 17/025; E05C 17/04; E05C 17/042; E05C 17/045; E05C 17/047; E05C 17/166; E05C 17/34; E05C 17/345; E05C 19/182; E05C 19/186; E05C 19/188; E05F 5/00; E05F 5/02; E05F 5/04; E05F 5/06; E05F 2005/046; E05D 11/00; E05D 11/087; E05D 2011/1092; Y10T 16/61
See application file for complete search history.

(56) References Cited

U.S. PATENT DOCUMENTS

| | | | | | |
|---|---|---|---|---|---|
| 73,120 | A * | 1/1868 | Reiber | E05D 5/12 | 16/263 |
| 232,580 | A * | 9/1880 | Welch | B62C 5/00 | 16/381 |
| 1,616,265 | A * | 2/1927 | Kroehling | E05C 17/025 | 109/60 |
| 1,805,324 | A * | 5/1931 | Bird | E05D 3/02 | 16/263 |
| 2,592,230 | A * | 4/1952 | Allen | E05D 11/06 | 16/223 |
| 2,660,750 | A * | 12/1953 | Wallen | E05D 11/06 | 16/223 |
| 2,799,888 | A * | 7/1957 | White | E05D 11/00 | 16/375 |
| 3,135,012 | A * | 6/1964 | Wessel | E05D 11/00 | 16/375 |
| 3,137,025 | A * | 6/1964 | Howard | E05C 17/025 | 16/83 |
| 3,157,906 | A * | 11/1964 | Wolf | E05D 11/00 | 16/223 |
| 3,325,854 | A * | 6/1967 | Steigerwald | E05C 17/025 | 16/375 |
| 3,333,294 | A * | 8/1967 | Warner | E05D 11/06 | 16/375 |
| 3,602,942 | A * | 9/1971 | Neff, Sr. | E05D 11/06 | 16/375 |
| 3,913,171 | A * | 10/1975 | Reid | E05F 5/06 | 16/342 |

(Continued)

*Primary Examiner* — Jeffrey O Brien
(74) *Attorney, Agent, or Firm* — Patrick D. Lowder, Esq.; Smith Tempel Blaha LLC

(57) ABSTRACT

A panel barrel hinge clip comprising a plate section and an annulus section are described. An article comprising the clip is described. A method of arresting movement of a swinging panel mounted on frame with a barrel hinge is described.

6 Claims, 5 Drawing Sheets

(56) References Cited

U.S. PATENT DOCUMENTS 3,971,099 A * 7/1976 Wallace ..... E05D 11/06 16/50
4,259,762 A * 4/1981 Civitelli ..... E05D 11/06 16/85
4,527,303 A * 7/1985 Civitelli ..... E05D 11/06 16/236
4,738,002 A * 4/1988 Shank ..... E05D 11/06 16/223
4,831,688 A * 5/1989 Deininger ..... E05F 5/04 16/319
4,841,283 A * 6/1989 Bubliewicz ..... E05D 11/00 200/61.7
4,858,273 A * 8/1989 Civitelli ..... E05D 11/06 16/236
5,044,681 A * 9/1991 Neighbors ..... E05C 17/025 16/319
5,237,724 A * 8/1993 Lee ..... E05C 17/025 16/375
5,265,922 A * 11/1993 Falcone ..... E05C 17/025 16/375
5,511,837 A * 4/1996 Dempsey ..... E05C 17/025 16/319
5,642,910 A * 7/1997 Betherum ..... E05C 17/025 16/319
5,711,557 A * 1/1998 Nicolosi ..... E05C 17/54 16/82
5,906,029 A * 5/1999 Fox ..... F16C 11/02 16/221
6,311,367 B1 * 11/2001 Larsen ..... E05F 3/221 16/375
6,497,005 B2 * 12/2002 Apostoloff ..... E05C 17/025 16/375
6,591,451 B2 * 7/2003 Gruber ..... E05D 5/121 16/254
7,559,114 B2 * 7/2009 Ranilovich ..... E05C 17/025 16/374
7,904,992 B2 * 3/2011 Agster ..... E05C 17/025 16/374
7,980,605 B1 * 7/2011 Fuhrman ..... E05C 19/182 292/258
8,099,834 B2 * 1/2012 Corso ..... E05D 5/12 16/342
8,156,613 B2 * 4/2012 Smith ..... E05D 11/06 16/374
8,220,202 B2 * 7/2012 Riley ..... E05D 11/00 16/223
8,327,505 B2 * 12/2012 Smith ..... E05D 3/02 16/374
8,678,453 B2 * 3/2014 Caliguri ..... E05C 17/025 292/288
8,863,561 B2 * 10/2014 Orlov ..... E05C 19/182 16/375
8,955,891 B2 * 2/2015 Millsap ..... E05C 17/025 16/82
9,127,489 B2 * 9/2015 Orlov ..... E05C 17/025
2006/0210060 A1 * 9/2006 Ishikawa ..... H04M 1/0227 379/433.13
2010/0038921 A1 * 2/2010 Kirkham ..... E05C 17/025 292/343
2012/0124776 A1 * 5/2012 McDonnell ..... E05D 11/06 16/375
2013/0168977 A1 * 7/2013 Caliguri ..... E05D 11/1014 292/288

* cited by examiner

DOOR SWING STOP

CROSS-REFERENCE TO RELATED APPLICATIONS

This is a utility patent application being filed in the United States as a non-provisional application for patent under Title 35 U.S.C. §100 et seq. and 37 C.F.R. §1.53(b) and, claiming the benefit of the prior filing date under Title 35, U.S.C. §119(e) of the United States provisional application for patent that was filed on Jul. 14, 2015, and assigned Ser. No. 62/192,252, which application is incorporated herein by reference in its entirety.

BACKGROUND

After installation, a door or panel vertically mounted on a frame may be moved out of a vertical orientation such that the door or panel will involuntarily move after being positioned. A former solution to this unwanted movement included removing the door or panel and adjusting, or re-shimming the frame to level the frame and thus restore the door or panel to vertical. After leveling, other cosmetic work, e.g., caulking and painting, may be needed to restore the frame and door/panel to an acceptable aesthetic level. Such procedures may risk damage to the door/panel and/or frame.

If the panel/door cannot be re-leveled and/or shimmed, a door or panel stop may be needed. Such a stop may be installed on a floor under the door or panel; or another type of hinge must be used.

SUMMARY

A barrel hinge clip may include a plate section configured to be mounted on a barrel hinge plate and an annulus section configured to receive a barrel hinge pin, wherein the plate and annulus sections are optionally reversibly attached to one another.

An article may include a first barrel hinge clip comprising a first plate section configured to engage a first barrel hinge plate and a first annulus section; a second barrel hinge clip comprising a second plate section configured to engage a second barrel hinge plate and a second annulus section wherein the first and second annulus sections are coaxially aligned; a threaded locking nut coaxially aligned with the first and second annulus sections; and an annular base plate and hollow screw coaxially aligned with the first and second annulus sections wherein the screw passes through the first and second annulus sections and is configured to engage the threaded locking nut.

A method to arrest panel movement of a panel rotatably mounted on a frame with a barrel hinge comprising: a) removing a barrel hinge pin from a barrel defined by a frame hinge plate mounted to the frame and a panel hinge plate mounted to the panel; b) mounting the article such that the first hinge clip engages the frame hinge plate and the second hinge clip engages the panel hinge plate; c) inserting the barrel hinge pin into the hollow screw and through the barrel; and d) rotating the threaded locking nut to compress the annuli sufficient to arrest panel movement.

DETAILED DESCRIPTION

Figure 1:
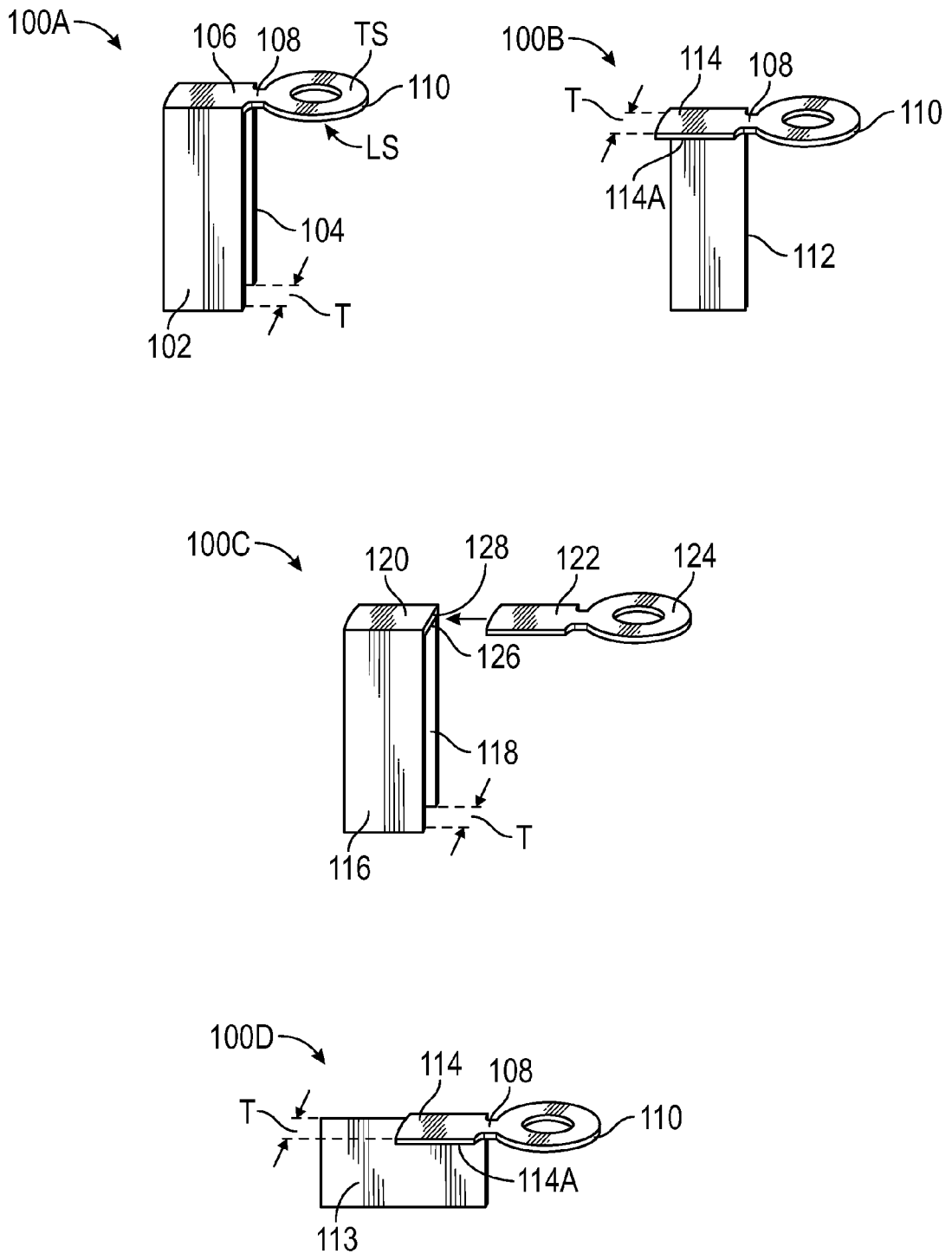
FIG. 1 shows front perspective views of barrel hinge clips according to the description.

In the description and claims of the present application, each of the verbs, "comprise", "include" and "have", and conjugates thereof, are used to indicate that the object or objects of the verb are not necessarily a complete listing of members, components, elements, or parts of the subject or subjects of the verb.

In this application the words "unit" and "module" are used interchangeably. Anything designated as a unit or module may be a stand-alone unit or a specialized module. A unit or a module may be modular or have modular aspects allowing it to be easily removed and replaced with another similar unit or module.

In an embodiment, clip 100A includes front flange 102 and back flange 104, both of which are joined by top flange 106. Flanges 102, 104 and 106 are configured to slidably engage a barrel hinge plate, as known to a person of ordinary skill in the art. The thickness T is selected to meet about the plate thickness as measured from the back to the front of the barrel hinge plate Annulus 110 is joined to top flange 106 by shank 108.

In an embodiment, clip 100B includes back flange 112 joined to top flange 114. Flanges 112 and 114 are configured to engage a barrel hinge plate, and in use, e.g., back flange 112 is positioned between a barrel hinge plate and frame or panel to which the hinge plate is attached. Annulus 110 is joined to top flange 114 by shank 108. The distance from the edge 114A to back flange 112 is about thickness T, defined above.

In an embodiment, clip 100C includes front flange 116 and back flange 118, both of which are joined by top flange 120. Divider 126 is spaced from top flange 120, within the void defined by flanges 116, 118 and 120, and is secured to flanges 116, 118, and/or 120 to define pocket 128. Shank 122 is joined to annulus 124. Shank 122 is configured to releasably, and/or tightly, fit within pocket 128. The thickness T is selected to meet about the plate thickness as measured from the back to the front of the barrel hinge plate.

In an embodiment, clip 100D includes back flange 113 joined to top flange 114. Flanges 113 and 114 are configured to engage a barrel hinge plate, and in use, e.g., back flange 113 is positioned between a barrel hinge plate and frame or panel to which the hinge plate is attached. Annulus 110 is joined to top flange 114 by shank 108. The distance from the edge 114A to back flange 113 is about thickness T, defined above The clip, annulus, and shank described supra may be formed of metal, a plastics, a composite, and the like. The clip, annulus, and shank may be manufactured by known methods to a person of ordinary skill in the art, including 3-D printing.

With respect to all figures, clips 100A-100D may be interchanged, as needed, with clips 202 and 204 depending on the configuration of the hinge, panel, and frame.

In an embodiment, the one or more surfaces, e.g., top surface TS or lower surface LS of the annuli 110 and/or 124 may be coated with a plastics, e.g., a nylon coating, or a fluorocarbon, e.g., a polytetrafluoroethylene polymer.

Figure 2:
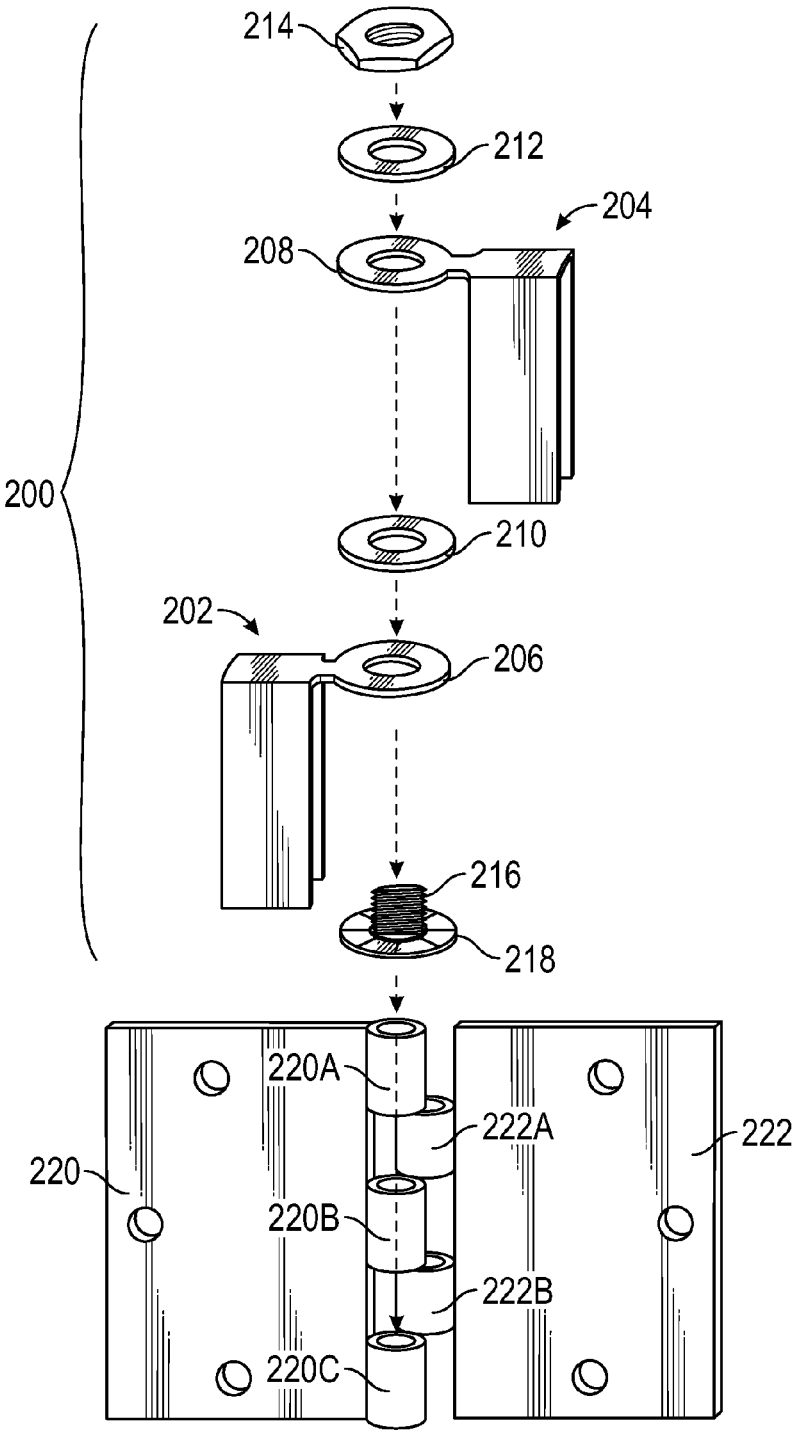
FIG. 2 is an exploded view of an article of the description and a barrel hinge on which the article may be mounted.
Figure 3:
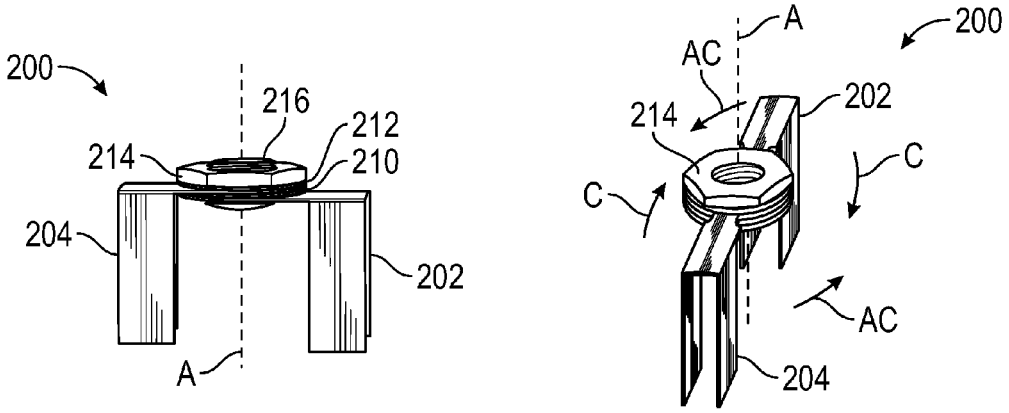
FIG. 3 shows perspective views of the article of FIG. 2.

With reference to FIG. 2 and FIG. 3, in an embodiment, the clips, annuli, and shanks described supra may be assembled to make an article 200. Clip 202 with annulus 206 is aligned with annulus 208 of clip 204 along axis A. Washer 210 may be positioned between annuli 206 and 208 along axis A. Washer 210 comprises, at least, upper and/or lower surfaces of minimal static friction coefficient such that clips 204 and 202 may turn clockwise (C), and anti-clockwise (AC) relative to each other about axis A, when in use.

In an embodiment, washers 210 and/or 212 may be manufactured of a material with a low coefficient of static friction. Non-limiting examples include a polytetrafluoroethylene polymer, a polyimide polymer, e.g., a Kapton® polymer, an aliphatic or aromatic polymer such as nylon, e.g., a PA 6, PA 66, PA 6/66 or PA 66/610 nylon.

In an embodiment, the washers 210 and/or 212 may be compressible and or may be resiliently biased along the direction of axis A or they may be bendable out of the plane of the washers.

In an embodiment the coating on annuli 206 and/or 208 and/or washers 210, 212, may comprise a material with a static coefficient of friction ($\mu_s$) of about 0.02 to about 0.25; or from about 0.04 to about 0.25; or from about 0.05 to about 0.2; or from about 0.1 to about 0.25; or from about 0.1 to about 0.2.

In an embodiment annuli 206 and/or 208, and/or washers 210, 212, may comprise a material with a static coefficient of friction ($\mu_s$) of about 0.02 to about 0.25; or from about 0.04 to about 0.25; or from about 0.05 to about 0.2; or from about 0.1 to about 0.25; or from about 0.1 to about 0.2.

In an embodiment, washer 212 may be positioned between the upper surface of annulus 208 and threaded nut 214 such that clip 204 may turn relative to nut 214. Nut 214 engages threaded, hollow screw 216 and may be tightened such that base plate 218 meets the underside of annulus 206.

In an embodiment, the base plate 218 may be fixed to annulus 206 by any method known to a person of ordinary skill in the art, e.g., welding, gluing, tacking, bonding, and the like. In this way, hollow screw 216 and base plate 216 do not turn when nut 214 is tightened, thus compressing 206, 208, 210 and/or 212.

In an embodiment, a threadlocking adhesive may be used to maintain a selected position of the tightened nut. For example, a cyanoacrylate, an epoxy, or other resin may be used. Such threadlocking adhesives may be known under the registered trademark LOCTITE® threadlocker.

Figure 2A:
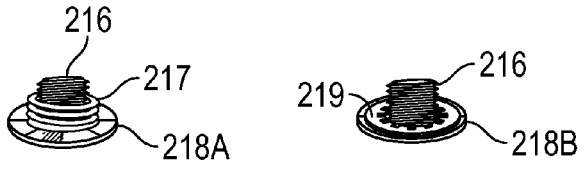
FIG. 2A shows front perspective views of an alternate embodiment of a subassembly according to the description.

In an alternative embodiment, with reference to FIG. 2 and FIG. 2A, base plate 218A and hollow post/threaded screw 216 engage coiled spring 217 such that when assembled with this alternative embodiment, article 200 has increased force operating against and thus compressing 206, 208, 210 and/or 212.

In an alternative embodiment, with reference to FIG. 2 and FIG. 2A, base plate 218A and hollow post/threaded screw 216 engage lock washer 219 such that when assembled with this alternative embodiment, article 200 has increased force operating against and thus compressing 206, 208, 210 and/or 212.

In an alternative embodiment, the screw, baseplate and nut combination may be substituted with a fastener or fastening module with a central hole configured to receive a barrel hinge pin. Such modules and equivalents thereof are known or are apparent to those of skill in the art.

Figure 3A:
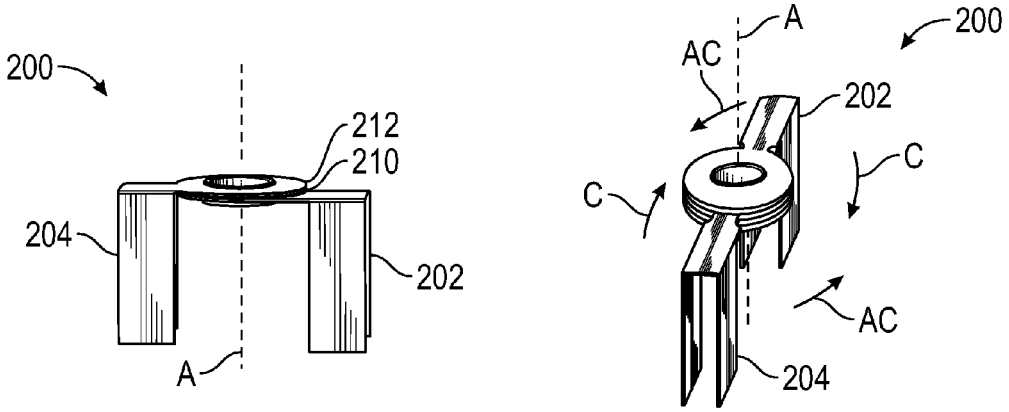
FIG. 3A shows perspective views of the alternate embodiment of the article.

With reference to FIG. 3A, such a fastener may include a rivet system wherein the bottom, or originally flared part of the rivet, is equivalent to base plate 218, and the rivet shaft is equivalent to hollow screw 216. After assembly, the top portion of the rivet shaft is flared and thus compresses 206, 208, 210, and 212.

In another embodiment, with respect to FIGS. 2, 216 and 218 may be manufactured as a single piece. In another embodiment, with respect to FIG. 2, FIG. 2A, FIG. 3, and FIG. 3A, the combination of 214, 216 and 218 may manufactured as a single piece.

Figure 4:
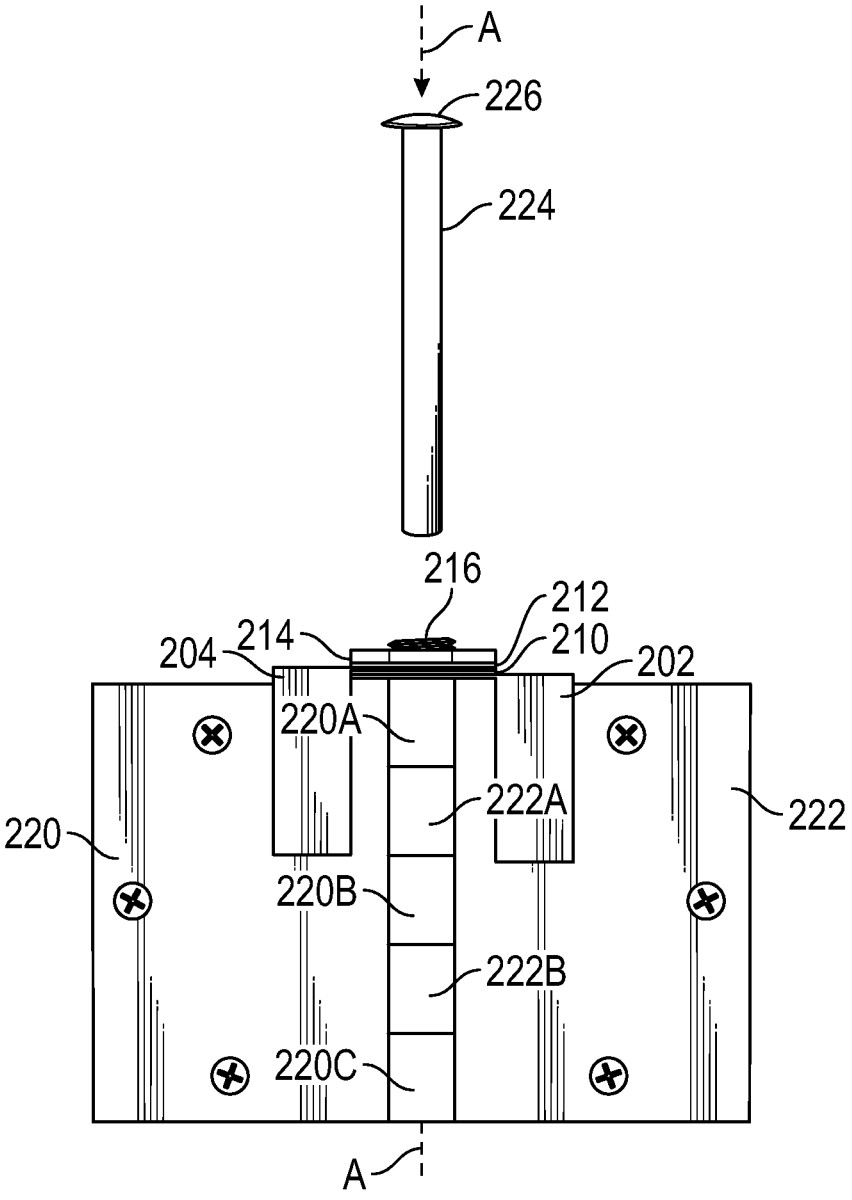
FIG. 4 is a front, partially exploded view of the article of FIG. 2, mounted on a barrel hinge.

With reference to FIG. 2, FIG. 3, and FIG. 4, article 200 is aligned along axis A such that clip 202 engages the upper edge of hinge plate 220 and clip 204 engages the upper edge of hinge plate 222. In this manner interlocking hinge plates knuckles 220A, 222A, 220B, 222B, and 220C are aligned along axis A. Barrel pin 224 is aligned along axis A and pressed through hollow screw 216 until top plate 226 meets the top of screw 226.

Figure 5:
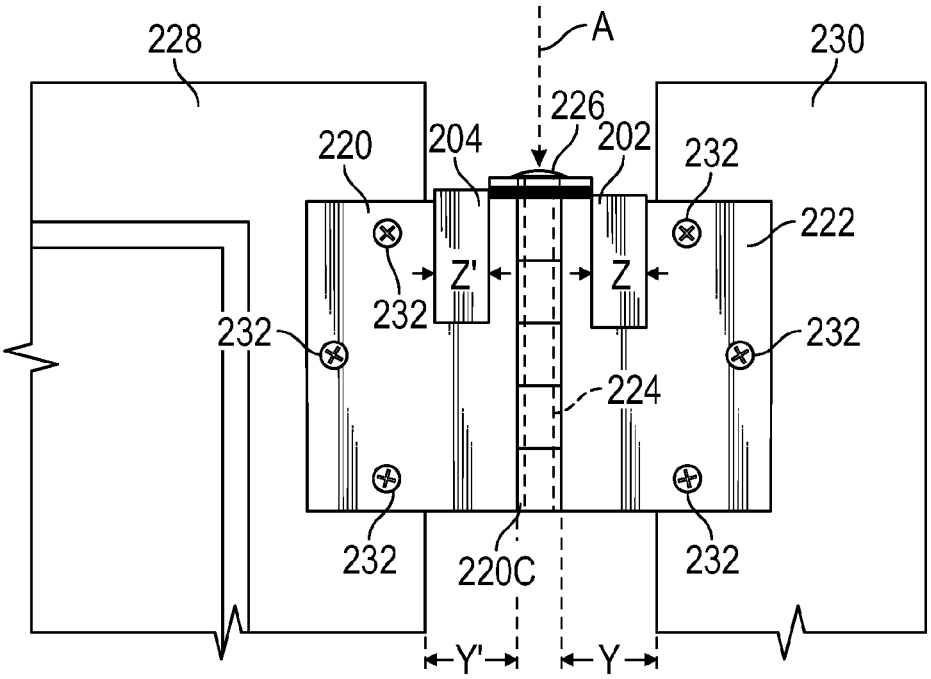
FIG. 5 is a front view of the article of FIG. 2, mounted on a barrel hinge which hinge is fixed to a frame and panel.

In an embodiment, and with respect to FIG. 5, hinge plate 220 is secured to a frame 228 and hinge plate 222 is secured to swinging panel 230, e.g., a door, a cabinet door, and the like, by one or more screws 232. In an embodiment, the width Z and/or Z' of clips 202 and/or 204, respectively, is less than or equal to distance Y and/or Y', respectively, a length from a hinge knuckle 220C to frame 228, and/or a distance from hinge knuckle 220C to panel 230. Y and Y' are optionally the same distances; and Z and Z' are optionally the same distances.

Should distances Y and/or Y' be less than Z and/or Z', the clips 202 and/or 204 may be fitted on hinge plates 220 and 222 before hinge plates 220 and/or 222 are secured with screws 232. Thus a portion of clip 204 may be secured between plate 220 and frame 228. Similarly, a portion of clip 202 may be secured between plate 222 and panel 230.

A method of arresting a door movement may be effected by mounting article 200 on base plates 220 and 222 and tightening nut 214 against screw 216 and base plate 218. The nut may be tightened until 206, 208, 210 and 212 are compressed such that panel 230, when rotated to certain position relative to frame 228, stays in position.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art.

It will be appreciated by persons skilled in the art that the present invention is not limited by what has been particularly shown and described herein above. Rather the scope of the invention is defined by the claims that follow.

What is claimed is:

1. An article for arresting panel movement of a panel rotatably mounted on a frame via a hinge, the article comprising:

a first barrel hinge clip comprising:

a first plate section configured to engage a first barrel hinge plate of the hinge, and a first annulus section configured to receive a barrel hinge pin of the hinge;

a second barrel hinge clip comprising:

a second plate section configured to engage a second barrel hinge plate of the hinge, and a second annulus section configure to receive the barrel hinge pin;

wherein the first and second annulus sections are coaxially aligned;

an adjustable friction mechanism for connecting the first and second barrel hinge clips comprising:

a threaded locking nut coaxially aligned with the first and second annulus sections; and an annular base plate and hollow screw configured to receive the barrel hinge pin coaxially aligned with the first and second annulus sections wherein the hollow screw passes through the first and second annulus sections and is configured to engage the threaded locking nut;

wherein the first barrel hinge clip is adapted to move with respect to the second barrel hinge clip for permitting the hinge to rotate about the barrel hinge pin; and the threaded locking nut and the hollow screw are adapted to be tightened in order to increase the friction between the first annulus section and the second annulus section to prevent unwanted movement.

2. The article according to claim 1 wherein the base plate is secured to one of the first or second annulus sections.

3. The article according to claim 1 wherein the first and/or second annulus sections is coated with a plastic material.

4. The article according to claim 1 further comprising a washer positioned between the first and second annulus sections.

5. The article according to claim 1 further comprising a washer positioned between one of the first or second annulus sections and the threaded locking nut.

6. A method to arrest panel movement of a panel rotatably mounted on a frame with a barrel hinge comprising:

a) removing a barrel hinge pin from a barrel defined by a frame hinge plate mounted to the frame and a panel hinge plate mounted to the panel;

b) mounting the article according to claim 1 such that the first hinge clip engages the frame hinge plate and the second hinge clip engages the panel hinge plate;

c) inserting the barrel hinge pin into the hollow screw and through the barrel; and d) rotating the threaded locking nut to compress the first and second annulus sections sufficient to arrest panel movement.

* * * * *